US011608825B2

(12) United States Patent
Kharpas et al.

(10) Patent No.: US 11,608,825 B2
(45) Date of Patent: Mar. 21, 2023

(54) DISPLACEMENT CONTROL WITH ANGLE SENSOR ADJUSTMENT

(71) Applicant: EATON INTELLIGENT POWER LIMITED, Dublin (IE)

(72) Inventors: Anil Balasaheb Kharpas, Pune (IN); Nirmaljeet Kulvindarsingh Johal, Nagapur (IN); Sanjay Dhondappa Mali, Pune (IN); Avinash Dadaso Patil, Pune (IN); Richard Randel Lyman, Chaska, MN (US); Matthew Edward Creswick, Shakopee, MN (US)

(73) Assignee: Danfoss Power Solutions II Technology A/S, Nordborg (DK)

( * ) Notice: Subject to any disclaimer, the term of this patent is extended or adjusted under 35 U.S.C. 154(b) by 352 days.

(21) Appl. No.: 16/776,172

(22) Filed: Jan. 29, 2020

(65) Prior Publication Data

US 2020/0248553 A1 Aug. 6, 2020

(30) Foreign Application Priority Data

Jan. 31, 2019 (IN) ..... 201911003901

(51) Int. Cl.

| | |
|---|---|
| ***F04B 49/00*** | (2006.01) |
| ***F04B 1/26*** | (2006.01) |
| ***F01B 3/10*** | (2006.01) |
| ***F03C 1/40*** | (2006.01) |

(52) U.S. Cl.

CPC ..... *F04B 49/002* (2013.01); *F01B 3/10* (2013.01); *F03C 1/0686* (2013.01); *F04B 1/26* (2013.01)

(58) Field of Classification Search

CPC .. F04B 49/002; F04B 1/26; F04B 1/28; F04B 1/30; F04B 1/29; F04B 1/295; F04B 1/32; F04B 1/324; F15B 15/2982; F15B 9/09; F01B 3/10; F03C 1/0686; F03C 1/005; G01B 5/24; G01B 7/30; G01B 9/10;

(Continued)

(56) References Cited

U.S. PATENT DOCUMENTS

| | | | |
|---|---|---|---|
| 3,429,225 | A | 2/1969 | Keyworth |
| 4,375,942 | A | 3/1983 | Olson |
| 4,543,787 | A | 10/1985 | Eckhardt |

(Continued)

FOREIGN PATENT DOCUMENTS

| | | | |
|---|---|---|---|
| EP | 0 087 773 | A1 | 9/1983 |
| EP | 1 892 413 | A1 | 2/2008 |

(Continued)

OTHER PUBLICATIONS

English Translation of JP2009243435, from EPO website Mar. 10, 2022 (Year: 2022).*

(Continued)

*Primary Examiner* — Bryan M Lettman
(74) *Attorney, Agent, or Firm* — Merchant & Gould P.C.

(57) ABSTRACT

Control systems and feedback assemblies for hydraulic axial displacement machines, such as pumps and motors. The control systems and feedback assemblies can have enhanced adjustability. An angle sensor for sensing the angular position of a pivot arm can have a housing, and the housing can be angularly adjustable about the pivot axis relative to the pivot arm.

18 Claims, 13 Drawing Sheets

(58) Field of Classification Search
CPC ..... G01B 11/26; G01B 21/22; G01B 13/18; G01C 1/00
See application file for complete search history.

(56) References Cited

U.S. PATENT DOCUMENTS

| | | | | |
|---|---|---|---|---|
| 7,121,188 | B2 | 10/2006 | Thoms et al. | |
| 7,171,887 | B2 | 2/2007 | Lilia | |
| 2004/0115065 | A1 | 6/2004 | Du et al. | |
| 2005/0084387 | A1 | 4/2005 | Klocke | |
| 2009/0224192 | A1 | 9/2009 | Oikawa et al. | |
| 2010/0077915 | A1* | 4/2010 | Loritz | F04B 1/324 91/358 R |
| 2016/0348654 | A1* | 12/2016 | Yasuda | F04B 1/2064 |
| 2020/0011308 | A1* | 1/2020 | Inada | F04B 49/002 |

FOREIGN PATENT DOCUMENTS

| | | | | |
|---|---|---|---|---|
| JP | 2004-150308 | A | 5/2004 | |
| JP | 2008-075556 | A | 4/2008 | |
| JP | 2009-243435 | A | 10/2009 | |
| JP | 2009243435 | * | 10/2009 | |
| JP | 2018-150870 | A | 9/2018 | |
| KR | 10-2004-0067269 | A | 7/2004 | |
| KR | 10-2012-0060441 | A | 6/2012 | |
| WO | WO2018168882 | * | 9/2018 | F04B 1/324 |
| WO | 2019/035891 | A1 | 2/2019 | |

OTHER PUBLICATIONS

Extended European Search Report for Application No. 20154209.9 dated May 4, 2020.
Series 42 Axial Piston Pumps, Technical Information, Sauer Danfoss, 69 pages (Jun. 2010).
Axial Piston Closed Circuit Pumps, Series 42, Service Manual, Danfoss, 76 pages (Jul. 2015).
Improve your time to market with greater design flexibility, MP1 Closed Circuit Axial Piston Pumps, Danfoss, 12 pages (Mar. 2016).
H1 Axial Piston Pumps, Single and Tandem, Product Line Overview, Danfoss, 8 pages (Apr. 2017).
H1 Axial Piston Pump 115/130 147/165, ISL Integrated Speed Limitation, Technical Information, Danfoss, 32 pages (Mar. 2018).
Series 42 Closed Circuit Axial Piston Pumps, Technical Information, Danfoss, 80 pages (Aug. 2018).
MP1 Axial Piston Pumps, 28/32 cm3, 38/45 cm3, Data Sheet, Danfoss, 2 pages (Jan. 2019).
MP1 Axial Piston Pumps, Size 28/32, 38/45, Technical Information, Danfoss, 98 pages (Jan. 2020).
Axial Piston Variable Pump AA10VG, Data Sheet, Rexroth Bosch Group, 44 pages (Jun. 2009).
Axial Piston Variable Pump A10VG Series 10, Instruction Manual, Rexroth Bosch Group, 64 pages (Jun. 2018).
Axial Piston Variable Pump A10VG Series 10, Rexroth Bosch, 60 pages (Dec. 2019).
Axial Piston Variable Pump A10VG Series 10, Operating Instructions, Rexroth Bosch Group, 60 pages (Feb. 2010).

* cited by examiner

DISPLACEMENT CONTROL WITH ANGLE SENSOR ADJUSTMENT

This application claims benefit of Serial No. 201911003901, filed 31 Jan. 2019 in India, the disclosure of which is incorporated herein by reference in its entirety. To the extent appropriate, a claim of priority is made to the above disclosed application.

BACKGROUND

In one example of a hydraulic axial displacement machine, such as an axial displacement pump or motor, the machine is operated by providing input command signals (e.g., electrical or hydraulic signals) from a controlling unit that provides hydraulic pressure to move one or more servo-pistons along their movement axis. In some examples, movement of the servo-piston(s) is transmitted to a swashplate, causing the angle of the swashplate to change. The angular position of the swashplate dictates the volumetric displacement generated by the axial displacement machine. When the swashplate is in a neutral position, i.e., perpendicular to a movement axis of the servo-piston, volumetric displacement goes to zero. The greater the obliqueness of the angular position of the swashplate relative to the movement axis of the servo-piston, the greater is the volumetric displacement.

Typically, a feedback system provides information regarding the position of the swashplate at a given point in time to help regulate the machine and adjust the angular position of the swashplate such that the volumetric displacement (i.e., the angular position of the swashplate) is consistent with the input control signal. Example feedback systems are disclosed by U.S. Pat. Nos. 7,121,188 and 7,171,887.

SUMMARY

In general terms the present disclosure is directed to control systems for hydraulic axial displacement machines.

According to certain aspects of the present disclosure, the control systems include a feedback assembly that provides feedback information that is proportional to a swashplate position relative to a neutral position.

According to certain aspects of the present disclosure, the feedback information provided by the feedback assembly is proportional to a drive command signal, the drive command signal being, e.g., electrical or hydraulic.

According to certain aspects of the present disclosure, a control system includes forward motion and reverse motions modules, the forward motion module being adapted to provide swashplate position information when the machine is driving a forward fluid flow, and the reverse motion module being adapted to provide swashplate position information when the machine is driving a reverse fluid flow.

Another aspect of the present disclosure relates to a control system for controlling an angular position of a swashplate of an axial piston hydraulic pump or motor. The angular position of the swashplate is determined by a servo-piston. The control system includes a valve arrangement for providing a charge pressure to the servo-piston which causes the servo-piston to alter the angular position of the swashplate. The control system also includes a pivot arm configured to pivot about a pivot axis in concert with movement of the servo-piston. The angular position of the pivot arm is indicative of the angular position of the swashplate. The pivot axis is adjustable in position with respect to the valve member and the servo-piston. The control system further includes an angle sensor for sensing the angular position of the pivot arm. The angle sensor is angularly adjustable about the pivot axis relative to the pivot arm. In certain examples, the adjustability of the pivot axis allows forward and reverse flow control characteristics to be balanced (e.g., symmetric, equalized) such that control signals of the same magnitude yield the same flow rates whether the system is operating in forward or reverse. In certain examples, the angle sensor senses swashplate positioning and provides feedback to a main controller. The main controller detects differences between the desired swashplate position based on the input command provided to the pump or motor and the actual swashplate position sensed by the angle sensor. The main control then takes corrective action to move the swashplate to the desired position (e.g., the input signal can be modified or re-calibrated until no error/difference exits). The ability to adjust the angle sensor allows the angle sensor to be rotationally adjusted to a position in which a neutral position of the sensor aligns with the pivot arm when the swashplate is in the neutral position. In this way, in the event the angle sensor fails, the system can continue to operate under electro-proportional displacement control with mechanical feedback provided by the pivot arm without internal biasing or spring loading within the angle sensor compromising balancing/centering of the pivot arm.

Although the control systems and feedback assemblies of the present disclosure will be described in connection with hydraulic axial displacement machines, it should be appreciated that principles disclosed herein may also be applied in other machines.

A variety of additional aspects will be set forth in the description that follows. The aspects relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not necessarily to scale and are intended for use in conjunction with the explanations in the following detailed description.

DETAILED DESCRIPTION

Figure 1:
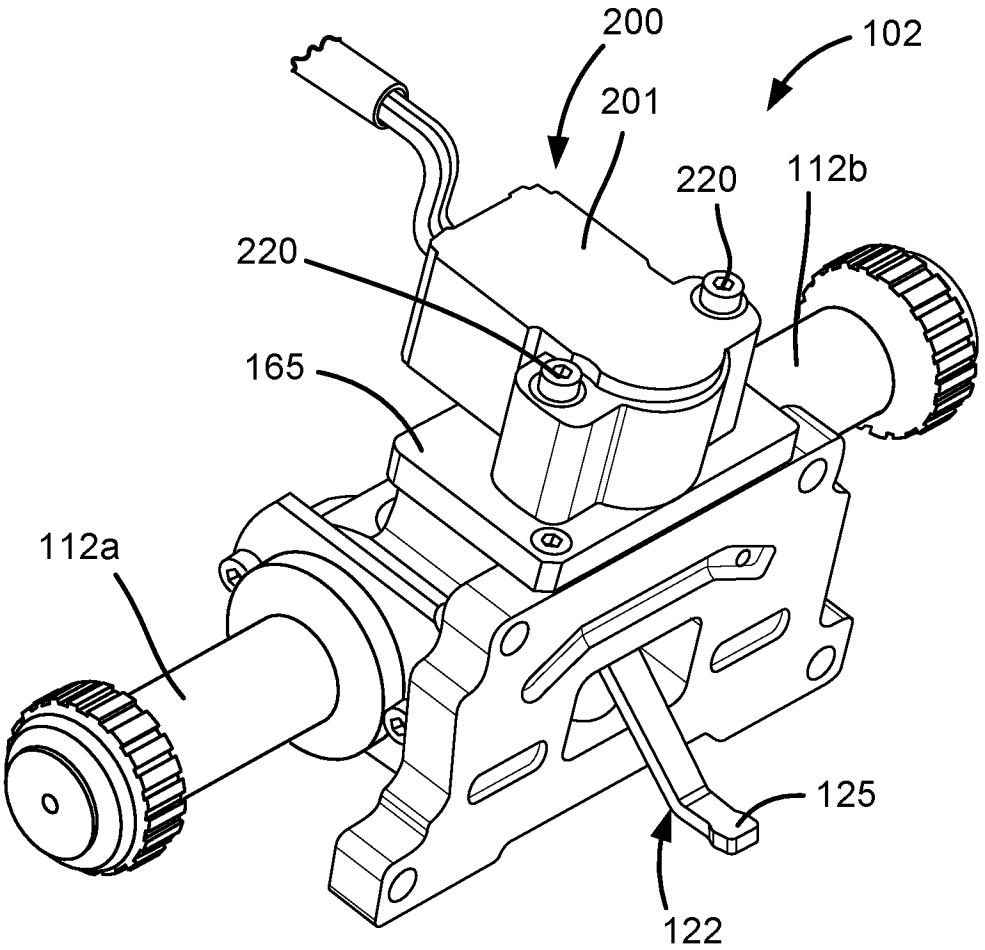
FIG. 1 is a perspective view of a control system in accordance with the principles of the present disclosure.
Figure 2:
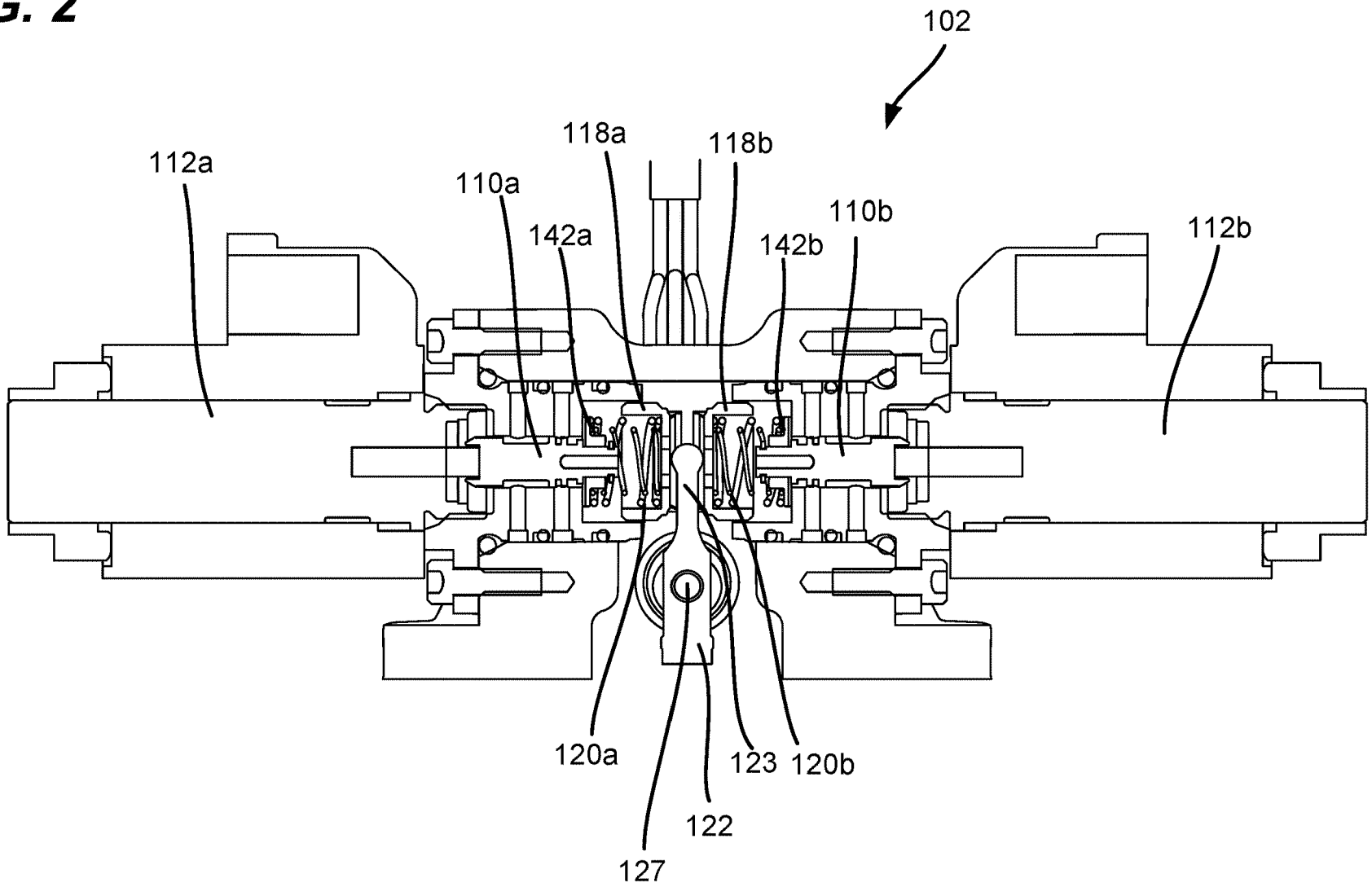
FIG. 2 is a cross-sectional view cut lengthwise through the control system of FIG. 1.
Figure 3:
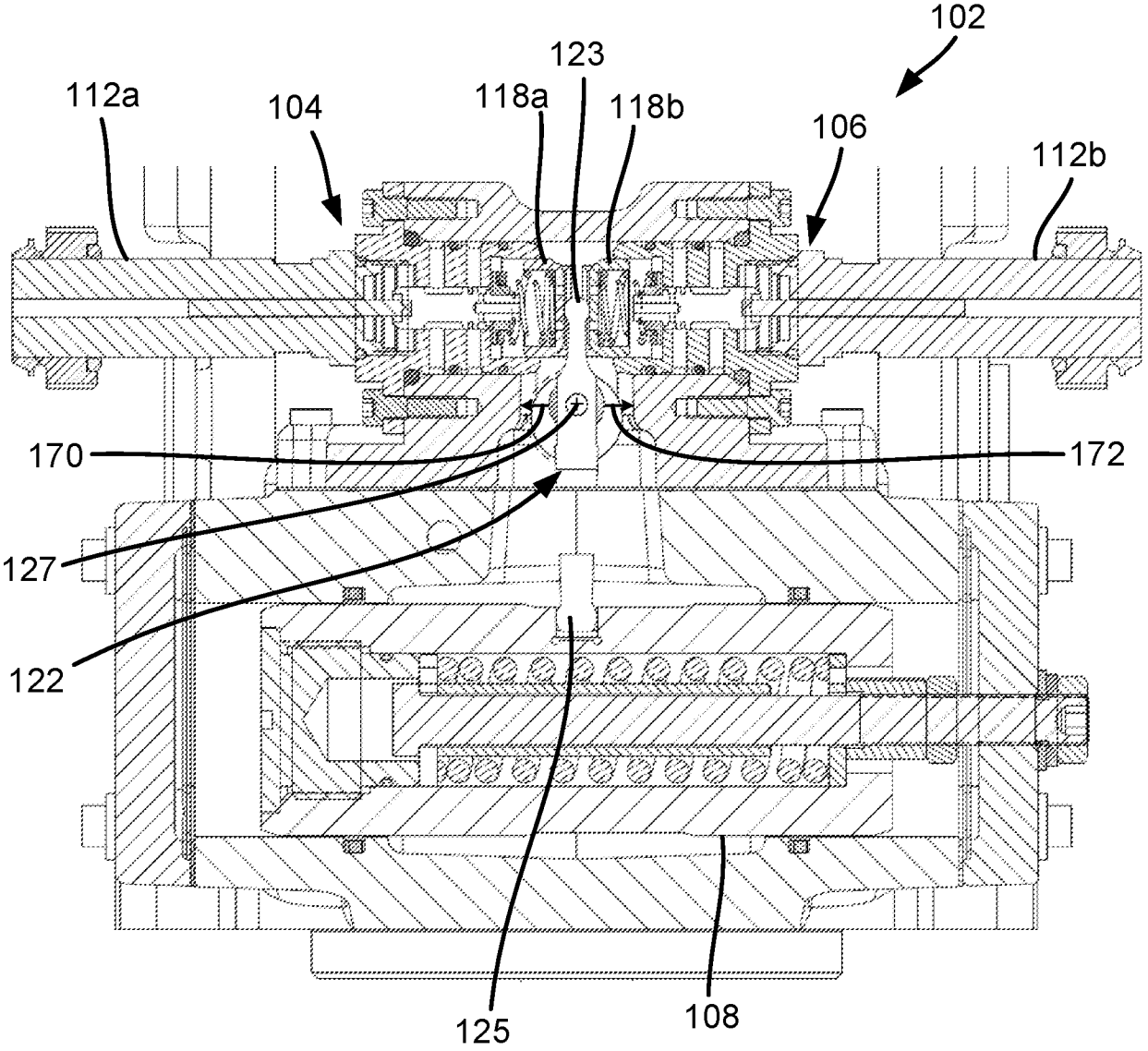
FIG. 3 is a cross-sectional view of the control system of FIG. 1 shown coupled to a servo-position for controlling positioning of a swashplate of a hydraulic pump or motor.

Referring to FIGS. 1 and 2, a control system 102 for a hydraulic axial displacement machine (e.g., see hydraulic machine 100 at FIG. 4) is schematically depicted. In some non-limiting examples the axial displacement machines described herein include hydraulic motors or hydraulic pumps. Such hydraulic axial displacement machines can be utilized in a wide variety of equipment having a hydraulics system or a hydraulics component, and the present disclosure is not limited to any particular type or types of equipment in which the hydraulic axial displacement machines described herein are implemented. The control system 102 includes a first control module 104 and a second control module 106. In some examples, the first and second control modules are of identical construction and include identical parts. The first control module 104 controls forward motion of a servo-piston 108. The second control module 106 controls reverse motion of the servo-piston 108.

Each control module 104, 106 includes, respectively, a valve arrangement including a spool 110*a*, 110*b*, a spool actuator 112*a*, 112*b* (e.g., a solenoid), an input line 114*a*, 114*b* and a charge pressure line 116*a*, 116*b* for charging the servo-piston 108, a feedback piston 118*a*, 118*b*, and a feedback piston spring 120*a*, 120*b*. Both modules are coupled to the same pivot arm 122 (e.g., a feedback arm or linkage). The control module 104 is active during forward motion of the hydraulic machine 100, and the control module 106 is active during reverse motion of the hydraulic machine 100. In this example control system 102, the feedback pistons 118*a*, 118*b*, the spools 110*a*, 110*b* and the spool actuators 112*a*, 112*b* are co-axially aligned along a central axis μl. The servo-piston 108 is coupled to a swashplate 124 (FIG. 4) of the hydraulic machine 100. The pivot arm 122 includes a first portion 123 (e.g., a first end or end portion) positioned between the pistons 118*a*, 118*b* and a second portion 125 (e.g., a second end or end portion) that engages the servo-piston 108. The pivot arm 122 pivots about a pivot axis 127 in concert (e.g., unison) with movement of the servo-piston 108. For example, movement of the servo-piston 108 drives/causes pivotal movement of the pivot arm 122 about the pivot axis 127.

When neither of the spools 110*a*, 110*b* is actuated by its corresponding solenoid 112*a*, 112*b*, case pressure in the servo-piston charge lines 116*a*, 116*b* maintains a swashplate 124 (FIG. 4) in a neutral position. An electrical charging signal is sent to the forward motion solenoid 112*a* or the reverse motion solenoid 112*b*, actuating the corresponding spool 110*a*, 110*b* and causing the spool to shift axially (along the axis A1) towards its corresponding feedback spring 122*a*, 122*b*. The spool shifts axially as a result of a force imparted by the corresponding solenoid 112*a*, 112*b*. The actuated spool 110*a*, 110*b* shifts axially proportionally to the magnitude of the charging signal, opening a communication between the pressure input line 114*a*, 114*b* and the servo-piston charge line 116*a*, 116*b* corresponding to the spool.

The charging pressure in the charge line 116*a*, 116*b*, causes the servo-piston to move in one direction corresponding to the actuated spool 110*a*, 110*b*, i.e., right or left in FIG. 1, corresponding to forward or reverse motion, respectively, of the machine 100.

Movement of the servo-piston 108 causes the pivot arm 122 to pivot about axis 127 such that the feedback piston 118*a*, 118*b* corresponding to the actuated spool shifts in the opposite direction (left or right) against the spring force provided by the corresponding feedback spring 120*a*, 120*b* of the feedback piston 118*a*, 118*b*. The desired swashplate angle is achieved when the axial force applied to the spool 110*a*, 110*b* by the solenoid 112*a*, 112*b* balances the axial force applied to the spool 110*a*, 110*b* by the corresponding feedback spring 120*a*, 120*b* of the corresponding feedback piston 118*a*, 118*b*. The generated axial spring force is proportional to the angle of the swashplate 124 relative to its neutral position.

As the charging signal on the solenoid 112*a*, 112*b* reduces or goes to zero, the actuating force on the corresponding spool 110*a*, 110*b* provided by the solenoid decreases and the force provided by the corresponding feedback spring 120*a*, 120*b* of the corresponding feedback piston 118*a*, 118*b* pushes the spool 110*a*, 110*b* towards, and ultimately to, its neutral position, thereby assisting in returning the spool 110*a*, 110*b* and the swashplate 124 to their neutral position. The amount of axial motion of the spool 110*a*, 110*b* towards its respective feedback piston 118*a*, 118*b* is proportional to the desired angle of the swashplate 124 relative to the neutral position of the swashplate 124.

The pivot arm 122 is not in direct contact with either spool 110*a*, 110*b* but rather cooperates with the spool 110*a*, 110*b* via the corresponding feedback piston 118*a*, 118*b* and feedback spring 120*a*, 120*b*. The feedback piston 118*a*, 118*b* can provide a seat 140*a*, 140*b*, respectively, for one axial end of the corresponding feedback spring 120*a*, 120*b*, with the opposing axial end of the feedback spring 120*a*, 120*b* abutting a spool-spring coupler 142*a*, 142*b*. The spool-spring coupler 142*a*, 142*b* transmits axial forces between the corresponding spool 110*a*, 110*b* and its corresponding feedback spring 120*a*, 120*b*.

The pivot arm 122 is configured to pivot about the pivot axis 127 in concert with movement of the servo-piston 108. An angular position of the pivot arm 122 is indicative of the angular position of the swashplate. The pivot axis 127 is defined by a pivot shaft 150 coupled to the pivot arm 122 by a cap bolt 152. The pivot arm 122 and the pivot shaft 150 are configured to rotate together about the pivot axis 127. The pivot axis 127 coincides with a longitudinal centerline of the pivot shaft 150. The pivot shaft 150 rotatably mounts within a pivot axis adjustment sleeve 154. For example, a head 155 of the pivot shaft 150 mounts for rotation within the sleeve 154, a shoulder 157 of the pivot shaft 150 seats on a lip 158 of the sleeve 154, and a shank 156 of the pivot shaft 150 extends through an opening in the sleeve 154. The pivot shaft 150 is eccentric with respect to the sleeve 154. The sleeve 154 mounts within a receptacle 160 defined by a housing 161 of the control system 102 which also supports the valve arrangement. Due to the eccentricity of the pivot shaft 150, the location of the pivot axis 127 relative to the valve arrangement and the servo-piston 108 can be adjusted by turning the sleeve 154 about its center axis within the receptacle 160. Notches 163 in an end of the sleeve 154 can receive a tool used to turn the sleeve 154 within the receptacle. The pivot axis 127 position can be adjusted to properly center the pivot arm 122 between the pistons 118*a*, 118*b* so that balanced loading is ensured between the two modules. In this way, the valve arrangement provides the same flow for a given signal magnitude regardless of whether the system is operating in forward or reverse. The axis 127 can be moved in a first direction 170 to increase spring loading at the first control module 104 and reduce spring loading at the second control module 106, and the axis can be moved in a second direction 172 to increase spring loading at the second control module 106 and reduce spring loading at the first control module 104. Once the loading has been balanced, the sleeve 154 can be locked in the set rotational position by a lateral set screw 176 that engages a side of the sleeve 154.

The control system 102 includes an arm angle sensor 200 (see FIGS. 1, 5 and 8-10), a sensor housing 201 of which is depicted as a component coupled to a plate 165 mounted at an exterior surface of control housing 161. In one example, the angle sensor 200 is a rotator encoder having a sensor shaft 210 that rotates about it center axis relative to internal sensing components within the sensor housing 201 which sense the degree of rotation. The sensor shaft 210 can be rotationally biased by the angle sensor toward a neutral rotational sensing position. The sensor housing 201 mounts to the plate 165 in a manner that allows a rotational position of the housing 201 to be rotationally adjusted relative to the plate 165 about the central axis of the sensor shaft 210. For example, the housing 201 can be secured to the plate 165 by fasteners 220 (e.g., bolts, screws, etc.) that extend through openings 222 defined by the housing 201. The openings 222 can be oversized, elongated or otherwise shaped to allow for rotational adjustment of the housing 201. In the depicted example, the openings 222 are slots that curve about the sensor shaft 210. Once the housing has been set at a desired rotational position relative to the plate 165, the fasteners 220 can be fully tightened to lock the housing 201 in the selected rotational position.

The plate 165 covers the sleeve 154 and the receptacle 160. The sensor shaft 210 extends through the plate 165 and engages the pivot shaft 150. The center of the sensor shaft 210 preferably aligns with the center of the pivot shaft 150. The pivot shaft 150 and the sensor shaft 210 are connected in such manner that they rotate together about the pivot axis 127. The sensor shaft 210 has an end with an elongate cross-section that fits or mate within a matching receptacle defined in one end of the pivot shaft 150. Thus, as the pivot arm 122 rotates about the pivot axis 127, the pivot shaft 150 and the sensor shaft 210 also rotate about the pivot axis 127. The ability to adjust the sensor housing 201 on the plate 165 allows the angle sensor to be rotationally adjusted such that the sensor shaft 210 is in the neutral position relative to the internal sensing components of the sensor when the pivot arm 122 is in a position corresponding to the swashplate being in the neutral position. In this way, in the event the angle sensor fails, the system can continue to operate under electro-proportional displacement control with mechanical feedback provided by the pivot arm without internal biasing or spring loading within the angle sensor compromising balancing/centering of the pivot arm 122.

Figure 4:
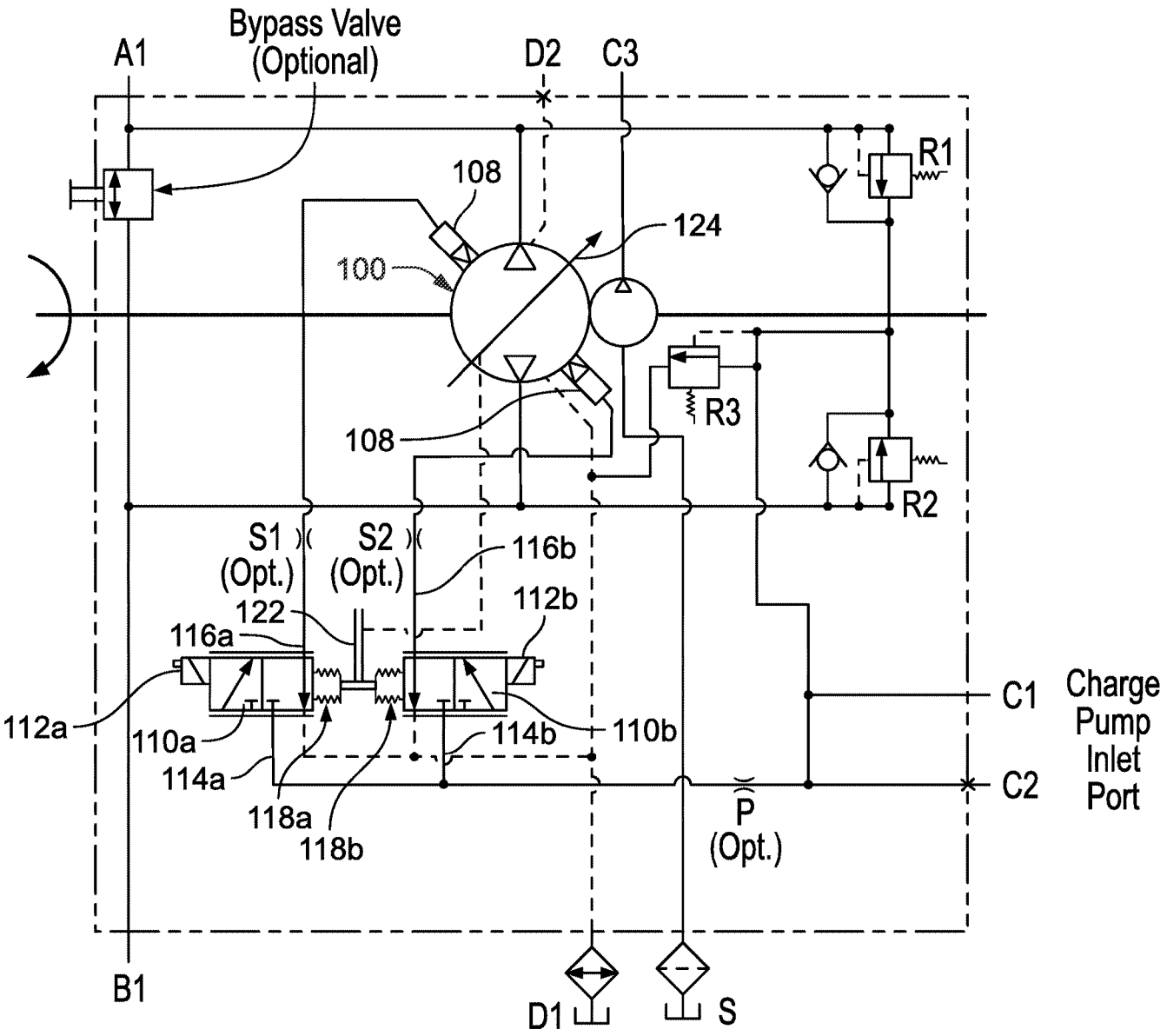
FIG. 4 is a schematic view showing the control system of FIG. 1 coupled to a servo-piston controlling the position of a swashplate of a hydraulic pump/motor.
Figure 5:
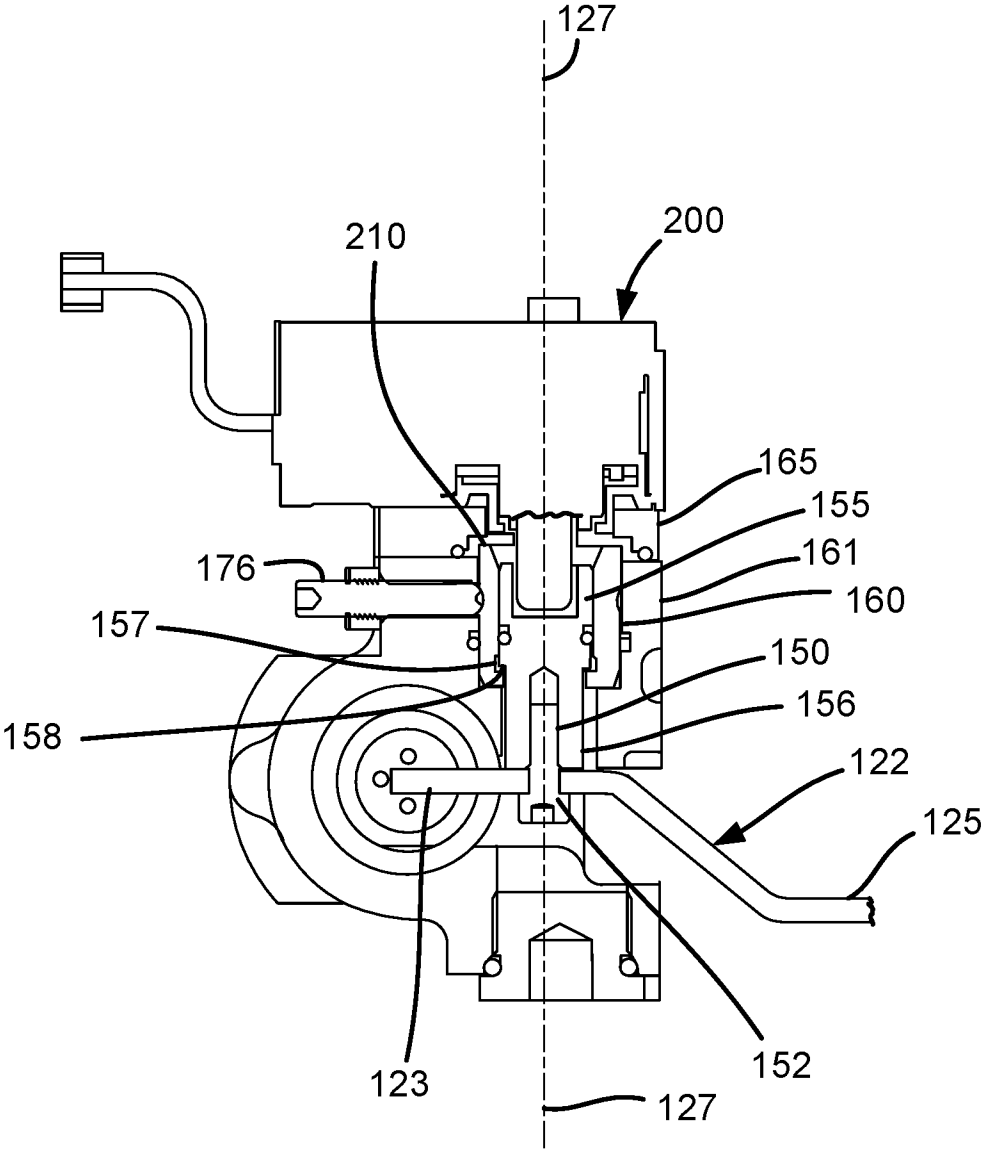
FIG. 5 is another cross-sectional view of the control system of FIG. 1 showing an angle sensor coupled to a pivot arm of the control system.
Figure 7:
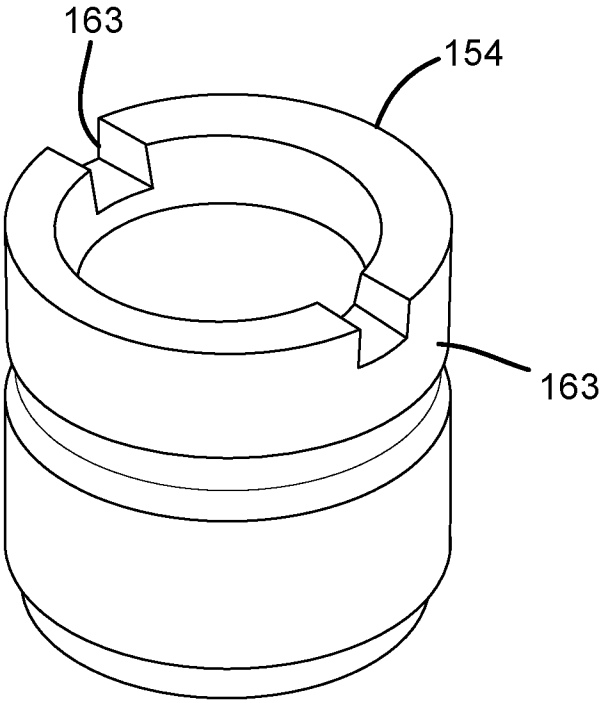
FIG. 7 is a perspective view of a pivot axis adjustment sleeve of the control system of FIG. 1.
Figure 6:
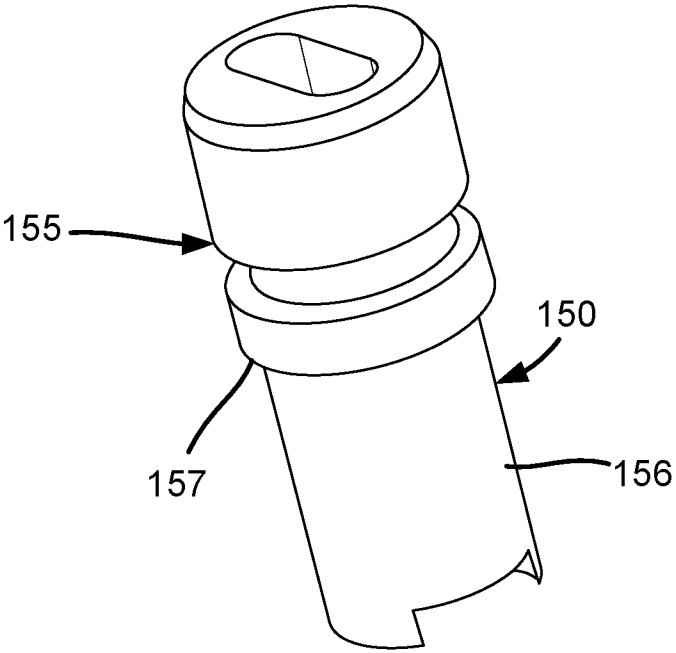
FIG. 6 is a perspective view of a pivot shaft of the control system of FIG. 1.
Figure 8:
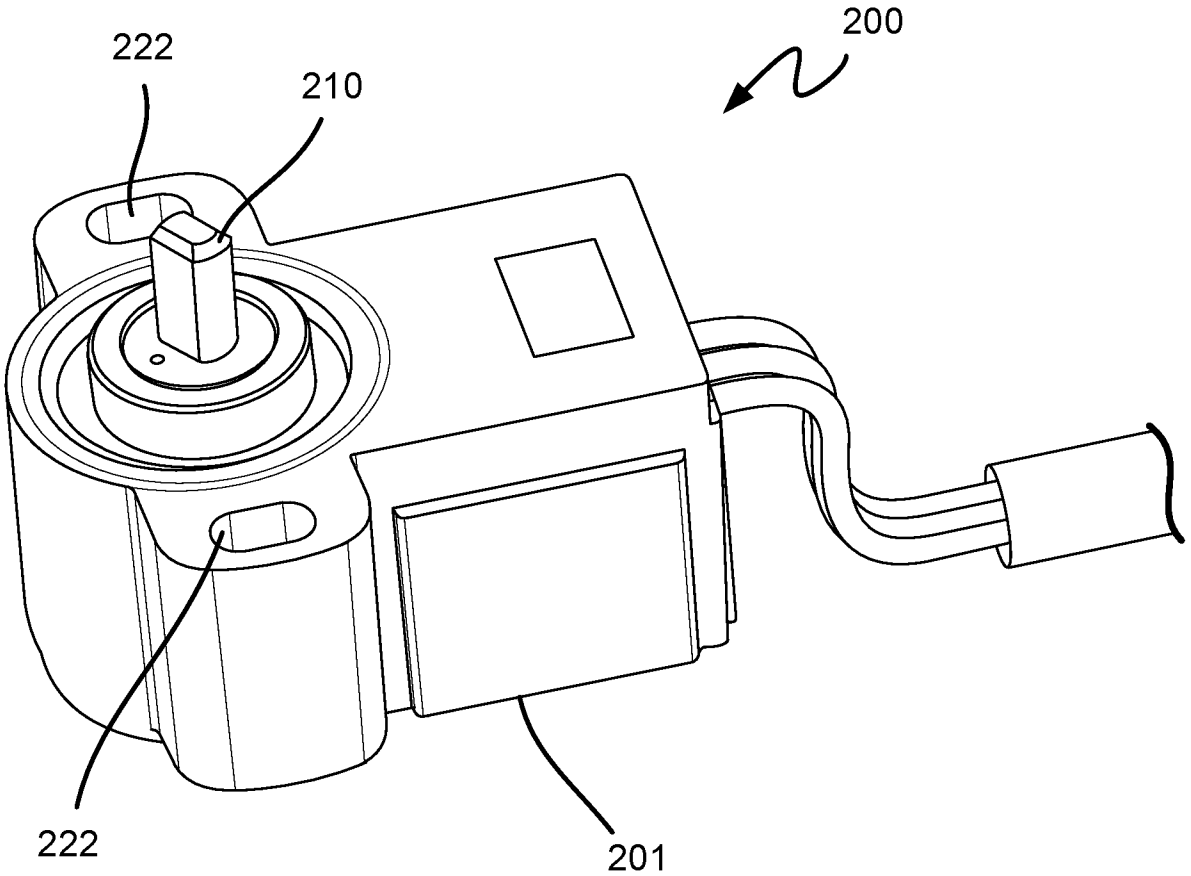
FIG. 8 is a perspective view of an angle sensor of the control system of FIG. 1.
Figure 9:
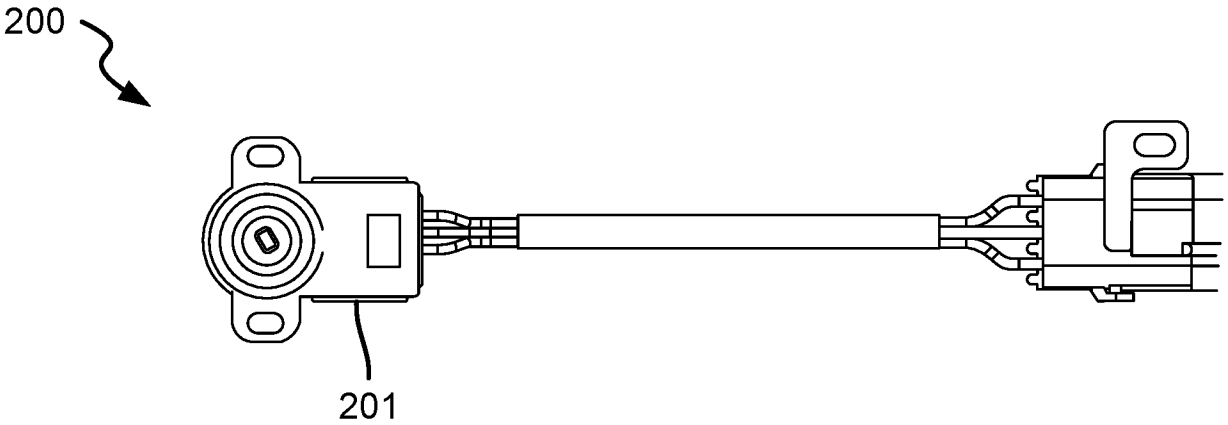
FIG. 9 is a plan view of the angle sensor of FIG. 8.
Figure 10:
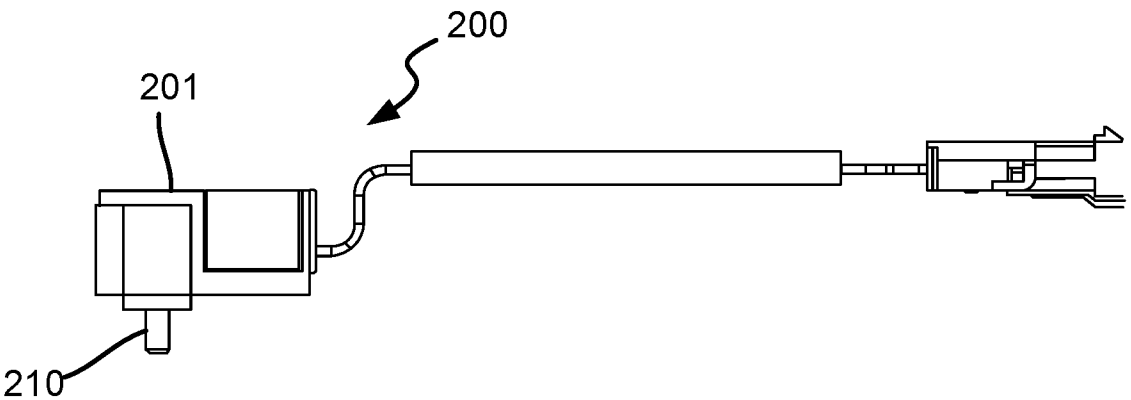
FIG. 10 is an elevation view of the angle sensor of FIG. 8.
Figure 11:
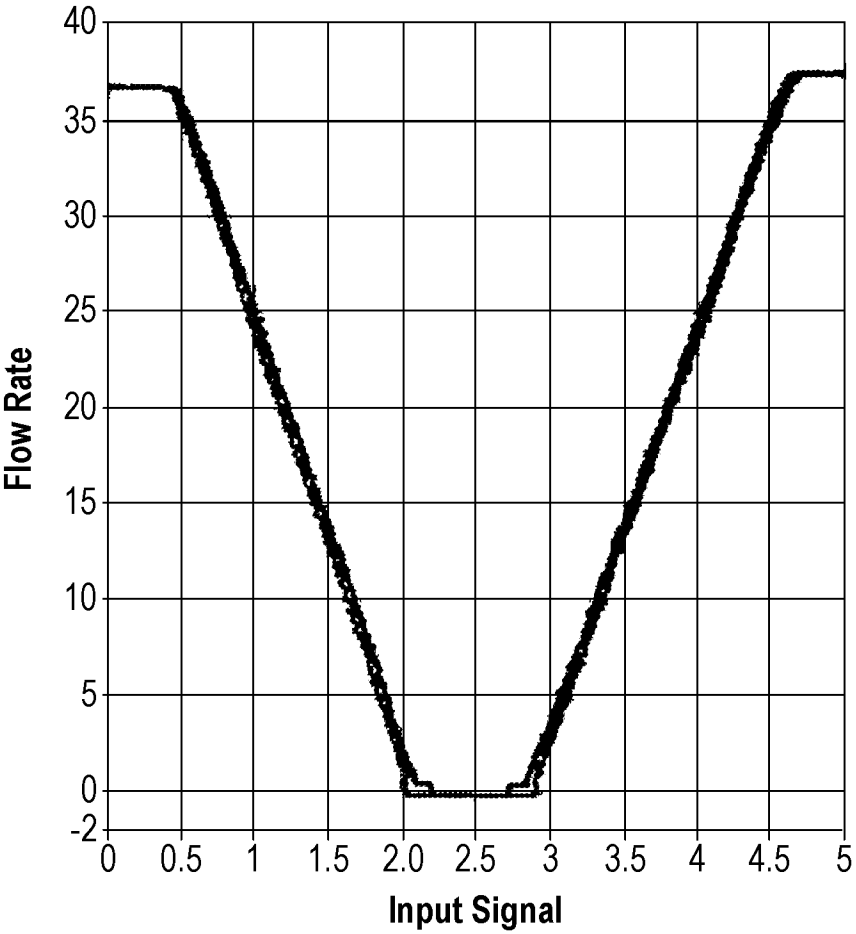
FIG. 11 is a graph plotting flow rate verses signal magnitude for the angle sensor of FIG. 8.
Figure 12:
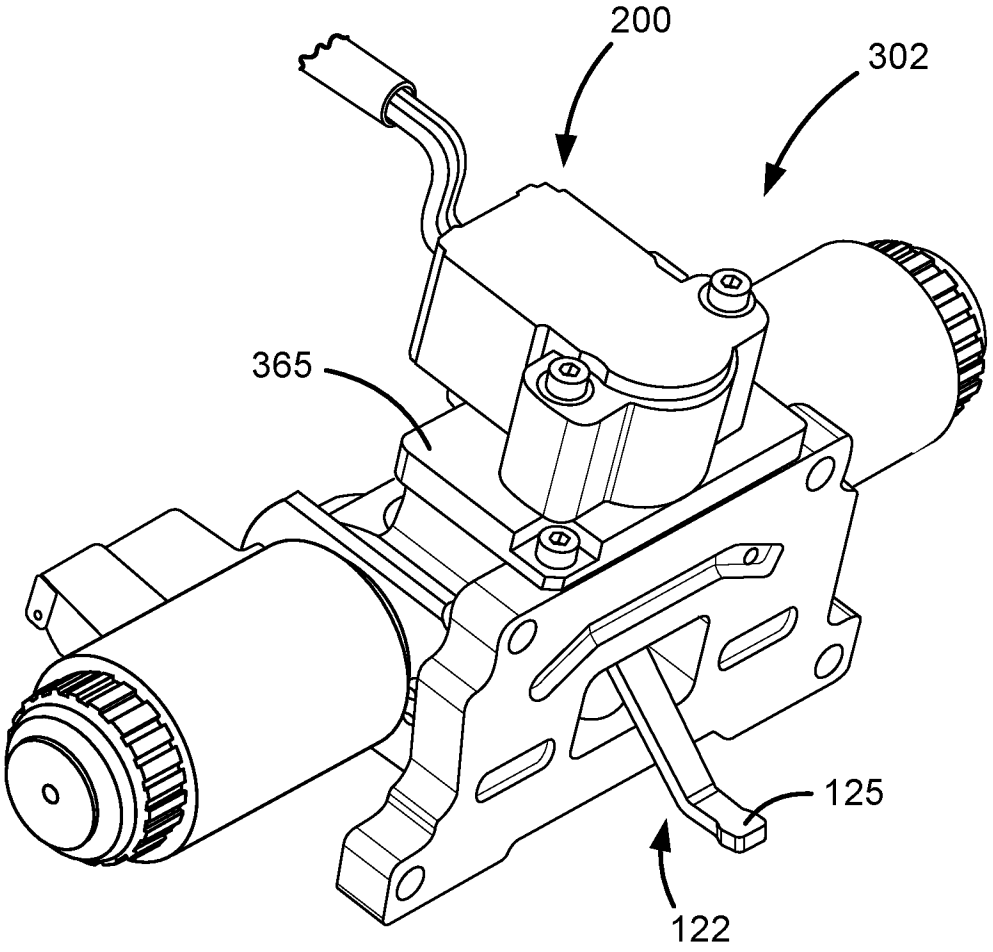
FIG. 12 is a perspective view of a further control system in accordance with principles of the present disclosure.
Figure 13:
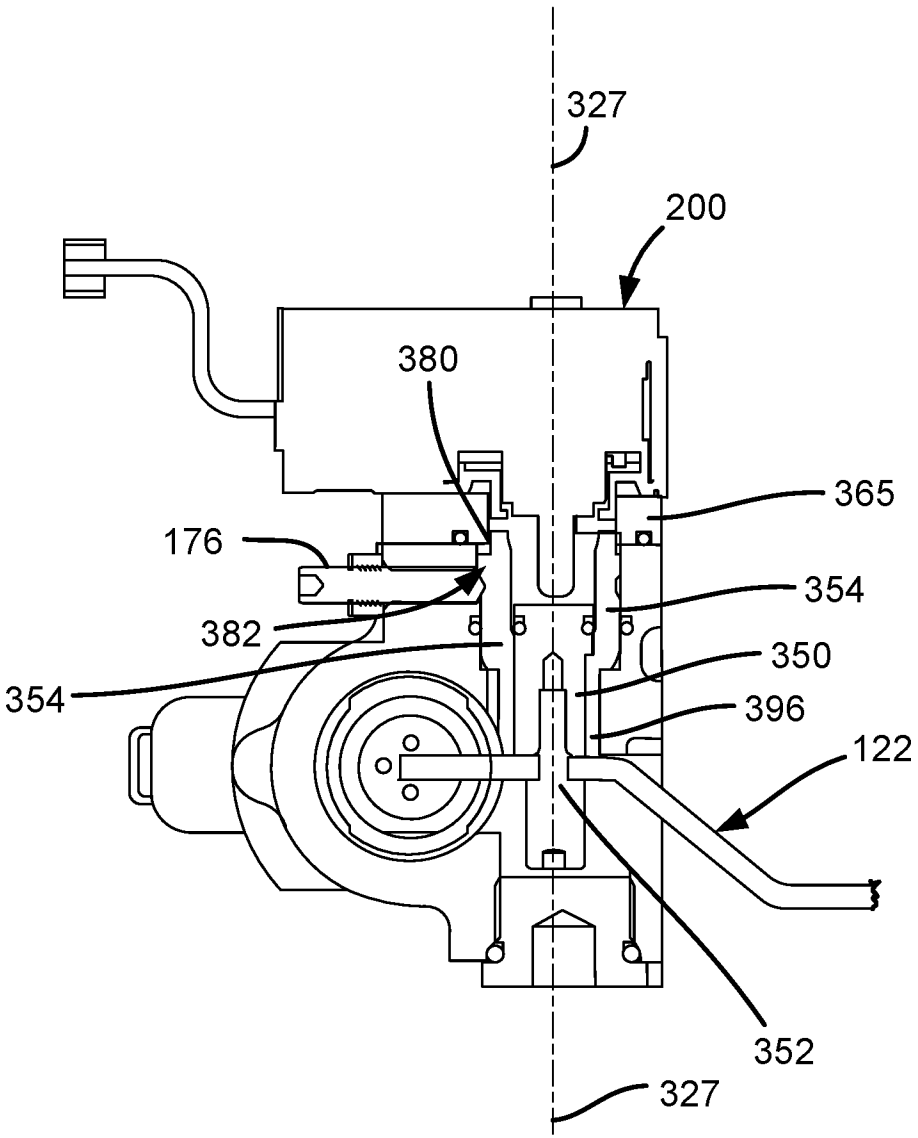
FIG. 13 is a cross-sectional view of the control system of FIG. 12 showing an angle sensor coupled to a pivot arm of the control system.
Figure 14:
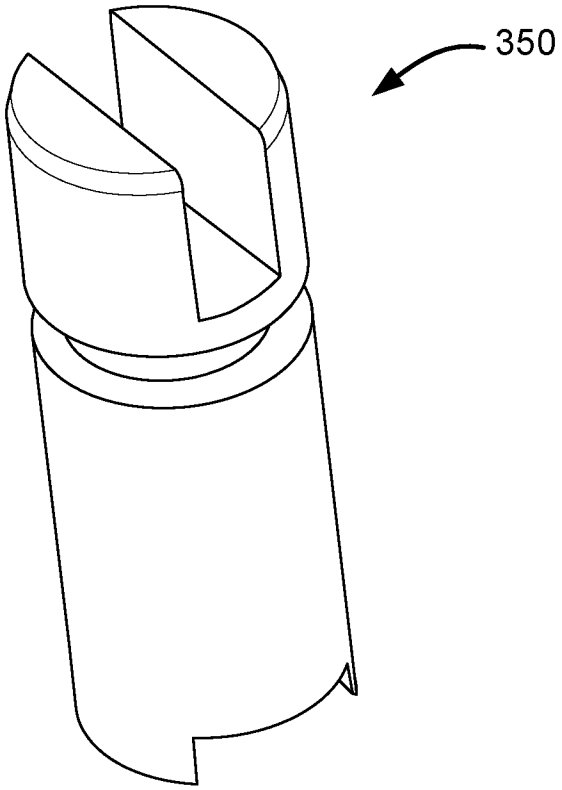
FIG. 14 is a perspective view of a pivot shaft of the control system of FIG. 12.
Figure 15:
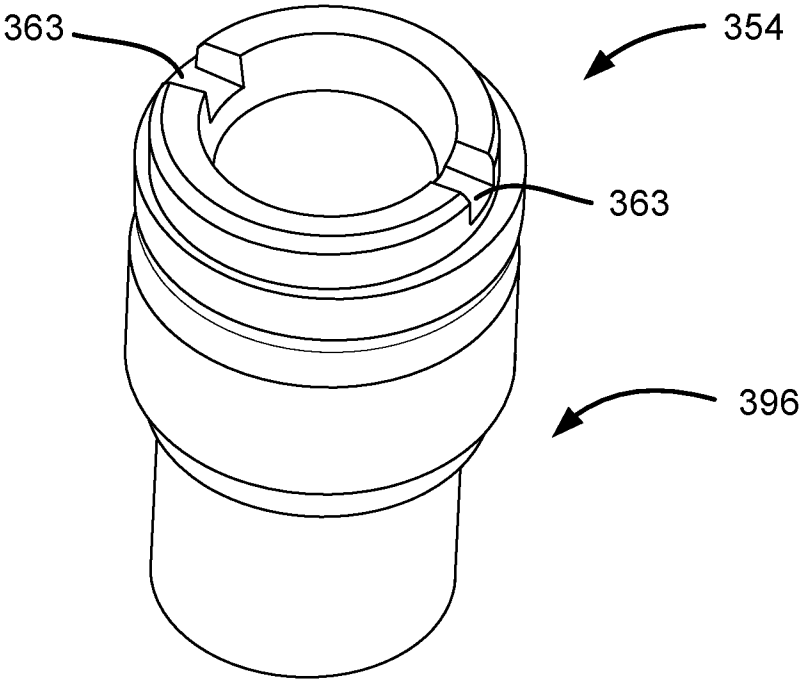
FIG. 15 is a perspective view of a pivot axis adjustment sleeve of the control system of FIG. 12.

The arm angle sensor 200 is adapted to detect pivoting of the feedback arm and provide signals corresponding to the pivot angle to a main controller. The main controller is configured to compare the sensed pivot angle with the electrical drive command signal (or other drive command signal, e.g., an hydraulic drive command signal) for driving the servo-piston 108. To the extent there is a discrepancy between the sensed pivot angle and the command signal, the main controller is adapted to provide an error correction signal to the appropriate solenoid or other spool actuator 112*a*, 112*b* to compensate for the discrepancy and thereby achieve the desired angle of the swashplate 124 (FIG. 4). The controller is thus operatively coupled to the solenoids 112*a*, 112*b* and is thereby adapted to send control signals to the solenoids 112*a*, 112*b*. FIG. 11 is a graph showing flow verses feedback signal magnitude. The sensor feedback signal magnitude ranges from 0-5 volts. The neutral position of the sensor 200 is set to 2.5 volts. 0-2.5 volts represents feedback in the forward operating mode and 2.5-5.0 volts represents feedback in the reverse operating mode.

In some examples the controller 522 includes, or is operatively coupled to, a processor that executes computer readable instructions stored on a memory, where the execution of the computer-readable instructions causes the controller 522 to provide the control signals needed to correct a discrepancy between a desired and an actual angle of the swashplate and to provide no correction signal when there is no discrepancy or less than a predetermined maximum threshold discrepancy.

In the depicted example, the pivot arm 122 is biased between two co-axially aligned valve spools. In other examples, a pivot arm can be spring-biased with respect to valve spools or other valve components that are not co-axially aligned. For example, valve spools can be parallel and side-by side with respect to one another and can each be spring biased against separate portions of a pivot arm as shown by FIG. 18 of PCT International application No. PCT/US2018/000157, which is hereby incorporated by reference in its entirety.

Referring to FIGS. 12-15, the control system 302 includes many corresponding features and principles of operation as the control system 102 described above, where like parts are referred to with like reference numerals. Consequently, the following description will focus on differences between the control system 302 and the control system 102.

The plate 365 of the control system 302 is configured to nest in a seat 382 defined by a recess 380 in a wall of the pivot axis adjustment sleeve 354. The seating of plate 365 in the seat 382 can provide for improved mechanical alignment between the sensor and the sleeve 354.

Notches 363 in an end of the sleeve 354 can receive a tool used to turn the sleeve 354 within the receptacle. The pivot axis 327 position can be adjusted to properly center the pivot arm 122 between the pistons so that balanced loading is ensured between the two modules.

The sleeve 354 has an extension portion 396 to enhance contact between the internal wall of the sleeve 354 and the shaft 350. The shaft 350, unlike the shaft 150, does not include a shoulder below the head and, correspondingly, the sleeve 354, unlike the sleeve 154, does not include lip where the shoulder of a shaft might otherwise rest. To restrict vertical movement of the shaft 350 and the feedback link, the cap bolt 352 is elongated along the axis 327 as compared with the cap bolt 152.

The configuration and arrangement of the shaft 350, the sleeve 354, the cap bolt 352, and the plate 365 can provide enhanced alignment of these components relative to one another within the system 302.

What is claimed is:

1. A control system for controlling an angular position of a swashplate of an axial piston hydraulic pump or motor, the angular position of the swashplate being determined by a servo-piston, the control system comprising:

a valve arrangement for providing a charge pressure to the servo-piston which causes the servo-piston to alter the angular position of the swashplate;

a pivot arm configured to pivot about a pivot axis in concert with movement of the servo- piston, wherein an angular position of the pivot arm is indicative of the angular position of the swashplate, and wherein the pivot axis is adjustable in position with respect to a valve member of the valve arrangement and the servo-piston;

a spring for transferring a spring load between the pivot arm and the valve member of the valve arrangement;

an angle sensor for sensing the angular position of the pivot arm, a housing of the angle sensor being configured to be angularly adjusted about the pivot axis relative to the pivot arm to angularly adjust a position of internal sensing components of the angle sensor about the pivot axis relative to the pivot arm; and a pivot shaft coupled to the pivot arm, the pivot shaft defining the pivot axis and being adapted to pivot in concert with the pivot arm about the pivot axis, the control system also including a pivot axis adjustment sleeve in which the pivot shaft is rotatably mounted, the pivot axis adjustment sleeve being mounted within a receptacle defined by a housing of the valve arrangement, the pivot shaft being eccentric with respect to the pivot axis adjustment sleeve such that rotation of the pivot axis adjustment sleeve about its center axis relative to the housing of the valve arrangement adjusts the position of the pivot axis with respect to the valve arrangement and the servo-piston.

2. The control system of claim 1, wherein the pivot axis adjustment sleeve is configured to be locked at a set rotational position about its center axis relative to the housing of the valve arrangement once the pivot axis is in a predefined position.

3. The control system of claim 2, wherein the pivot axis adjustment sleeve is locked in the set rotational position by a locking screw that laterally engages the pivot axis adjustment sleeve.

4. The control system of claim 2, wherein a plate mounts to the housing of the angle sensor over the receptacle for the pivot axis adjustment sleeve, and wherein the angle sensor mounts on the plate.

5. The control system of claim 4, wherein the angle sensor incudes an angle sensing shaft that extends through the plate and engages the pivot shaft such that the angle sensing shaft and the pivot shaft are configured to rotate together about the pivot axis.

6. The control system of claim 5, wherein the pivot shaft defines a receiver at one end for receiving an end of the angle sensing shaft, and wherein the angle sensing shaft and the receiver have matching non-circular cross-sectional shapes.

7. The control system of claim 5, wherein the sensor housing mounts to the plate, and wherein the sensor housing is rotationally adjustable relative to the plate about the pivot axis, and wherein the sensor housing and related internal sensing circuitry rotates relative to the angle sensing shaft when the sensor housing is rotationally adjusted to allow the angle sensor to be set at a neutral rotational sensing position relative to the pivot arm when the pivot arm is in a position corresponding to the neutral position of the swashplate.

8. The control system of claim 7, wherein the sensor housing mounts to the plate with fasteners, wherein the sensor housing defines fastener openings through which the fasteners extend, and wherein the fastener openings are sized and shaped to allow for a limited range of rotational movement of the sensor housing relative to the plate about the pivot axis prior to full tightening of the fasteners.

9. The control system of claim 8, wherein full tightening of the fasteners rotationally locks the sensor housing in place relative to the plate.

10. The control system of claim 1, wherein the valve member includes a valve spool that is moved by a solenoid.

11. The control system of any of claim 1, wherein the valve member is a first valve spool, wherein the valve arrangement includes a second valve spool co-axially aligned with the first valve spool along a valve axis, wherein first and second solenoids respectively move the first and second valve spools along the valve axis, wherein a first end of the pivot arm is positioned between the first and second valve spools, wherein a second end of the pivot arm engages the servo-piston, wherein the pivot axis is positioned between the first and second ends of the pivot arm, wherein actuation of the first solenoid causes the servo-piston to operate the pump or motor in a forward mode, and wherein actuation of the second solenoid causes the servo-piston to operate the pump or motor in a reverse mode.

12. The control system of claim 11, wherein the position of the pivot axis is adjusted to move the pivot arm either toward the first valve spool or toward the second valve spool to set the pivot arm in a position in which balanced flow characteristics are achieved for both forward and rearward operation of the pump or motor.

13. The control system of claim 12, wherein the spring is a first spring, the control system further comprising:

a first piston, the first piston and the first spring both positioned between the first end of the pivot arm and the first valve spool;

a second piston; and a second spring, the second piston and the second spring both positioned between the first end of the pivot arm and the second valve spool.

14. A control system for controlling an angular position of a swashplate of an axial piston hydraulic pump or motor, the angular position of the swashplate being determined by a servo-piston, the control system comprising:

a valve arrangement for providing a charge pressure to the servo-piston which causes the servo-piston to alter the angular position of the swashplate;

a pivot arm configured to pivot about a pivot axis in concert with movement of the servo- piston, wherein an angular position of the pivot arm is indicative of the angular position of the swashplate, and wherein the pivot axis is adjustable in position with respect to a valve member of the valve arrangement and the servo-piston;

a spring for transferring a spring load between the pivot arm and the valve member of the valve arrangement; and a pivot shaft coupled to the pivot arm, the pivot shaft defining the pivot axis and being adapted to pivot in concert with the pivot arm about the pivot axis, the control system also including a pivot axis adjustment sleeve in which the pivot shaft is rotatably mounted, the pivot axis adjustment sleeve being mounted within a receptacle defined by a housing of the valve arrangement, the pivot shaft being eccentric with respect to the pivot axis adjustment sleeve such that rotation of the pivot axis adjustment sleeve about its center axis relative to the housing of the valve arrangement adjusts the position of the pivot axis with respect to the valve arrangement and the servo-piston.

15. The control system of claim 14, wherein the pivot axis adjustment sleeve is configured to be locked at a set rotational position about its center axis relative to the housing of the valve arrangement once the pivot axis is in a predefined position.

16. A control system for controlling an angular position of a swashplate of an axial piston hydraulic pump or motor, the angular position of the swashplate being determined by a servo-piston, the control system comprising:

a valve arrangement for providing a charge pressure to the servo-piston which causes the servo-piston to alter the angular position of the swashplate;

a pivot arm configured to pivot about a pivot axis in concert with movement of the servo-piston, wherein an angular position of the pivot arm is indicative of the angular position of the swashplate;

a spring for transferring a spring load between the pivot arm and a valve member of the valve arrangement; and an angle sensor for sensing the angular position of the pivot arm, a housing of the angle sensor including slots configured to receive fasteners that secure the housing, the slots being curved to allow the housing to be angularly adjusted about the pivot axis relative to the pivot arm to angularly adjust a position of internal sensing components of the angle sensor about the pivot axis relative to the pivot arm.

17. The control system of claim 16, wherein a plate mounts to the housing of the angle sensor, and wherein the angle sensor mounts on the plate.

18. The control system of claim 17, wherein the angle sensor incudes an angle sensing shaft that extends through the plate and engages a pivot shaft coupled to the pivot arm such that the angle sensing shaft and the pivot shaft are configured to rotate together about a pivot axis.

* * * * *